US009062503B2

(12) United States Patent
Lehr

(10) Patent No.: US 9,062,503 B2
(45) Date of Patent: Jun. 23, 2015

(54) ROTARY COIL TUBING DRILLING AND COMPLETION TECHNOLOGY

(75) Inventor: Joerg Lehr, Lower Saxony (DE)

(73) Assignee: BAKER HUGHES INCORPORATED, Houston, TX (US)

( * ) Notice: Subject to any disclaimer, the term of this patent is extended or adjusted under 35 U.S.C. 154(b) by 0 days.

(21) Appl. No.: 13/187,180

(22) Filed: Jul. 20, 2011

(65) Prior Publication Data

US 2012/0024539 A1 Feb. 2, 2012

Related U.S. Application Data

(60) Provisional application No. 61/366,457, filed on Jul. 21, 2010.

(51) Int. Cl.

| | |
|---|---|
| ***E21B 23/00*** | (2006.01) |
| ***E21B 19/22*** | (2006.01) |
| ***E21B 7/06*** | (2006.01) |
| ***E21B 17/00*** | (2006.01) |

(52) U.S. Cl.

CPC ..... *E21B 19/22* (2013.01); *E21B 7/068* (2013.01); *E21B 17/00* (2013.01)

(58) Field of Classification Search

USPC ..... 175/61, 62, 51, 107, 175, 171, 172, 175/170; 166/242.6, 381

See application file for complete search history.

(56) References Cited

U.S. PATENT DOCUMENTS

| | | | | |
|---|---|---|---|---|
| 4,333,539 | A | 6/1982 | Lyons et al. | |
| 4,678,045 | A | 7/1987 | Lyons | |
| 5,148,877 | A | 9/1992 | MacGregor | |
| 5,251,695 | A | 10/1993 | Coronado | |
| 6,056,051 | A | 5/2000 | Coronado | |
| 6,269,883 | B1 * | 8/2001 | Gissler et al. | 166/340 |
| 6,290,002 | B1 * | 9/2001 | Comeau et al. | 175/73 |
| 6,571,888 | B2 | 6/2003 | Comeau et al. | |
| 7,195,083 | B2 * | 3/2007 | Eppink et al. | 175/61 |
| 7,237,809 | B2 | 7/2007 | Connell | |
| 7,249,633 | B2 | 7/2007 | Ravensbergen et al. | |
| 2003/0205372 | A1 * | 11/2003 | Norris et al. | 166/77.2 |
| 2004/0084191 | A1 | 5/2004 | Laird | |
| 2006/0243453 | A1 | 11/2006 | McKee | |
| 2008/0164062 | A1 * | 7/2008 | Brackin et al. | 175/24 |
| 2008/0314643 | A1 * | 12/2008 | Lavrut et al. | 175/62 |
| 2009/0301711 | A1 * | 12/2009 | Jagert et al. | 166/242.6 |
| 2010/0018770 | A1 | 1/2010 | Moriarty et al. | |
| 2010/0071892 | A1 | 3/2010 | Mackenzie | |
| 2011/0089685 | A1 | 4/2011 | McKee et al. | |

* cited by examiner

*Primary Examiner* — David Bagnell
*Assistant Examiner* — Taras P Bemko
(74) *Attorney, Agent, or Firm* — Mossman, Kumar & Tyler PC

(57) ABSTRACT

An apparatus for performing a drilling operation or a non-drilling wellbore operation may include a string that has a rigid tubular, a connector coupled to the rigid tubular, a non-rigid tubular coupled to the connector; and at least one motor positioned along the string. In some embodiments, a plurality of motors may be positioned along the string to rotate one or both of the non-rigid tubular and a drill bit connected to the string. In some embodiments, the connector may be configured to release the non-rigid tubular from the rigid tubular and thereby leave the non-rigid tubular in the wellbore.

18 Claims, 5 Drawing Sheets

ROTARY COIL TUBING DRILLING AND COMPLETION TECHNOLOGY

CROSS-REFERENCE TO RELATED APPLICATIONS

This application claims priority from U.S. Provisional Patent Application Serial No.: 61/366,457 filed Jul. 22, 1010 the disclosure of which is incorporated herein by reference in its entirety.

BACKGROUND OF THE DISCLOSURE

1. Field of the Disclosure

This disclosure relates generally to oilfield downhole tools and more particularly to drilling assemblies utilized for directionally drilling wellbores.

2. Background of the Art

To obtain hydrocarbons such as oil and gas, boreholes or wellbores are drilled by rotating a drill bit attached to the bottom of a drilling assembly (also referred to herein as a "Bottom Hole Assembly" or ("BHA"). The drilling assembly is attached to the bottom of a tubing, which is usually either a jointed rigid pipe or a relatively flexible spoolable tubing commonly referred to in the art as "coiled tubing." The string comprising the tubing and the drilling assembly is usually referred to as the "drill string." When jointed pipe is utilized as the tubing, the drill bit may be rotated by rotating the jointed pipe from the surface and/or by a drilling motor contained in the drilling assembly. In the case of a coiled tubing, the drill bit may be rotated by the drilling motor.

Conventionally, a rig operation uses either coiled tubing or jointed pipe. In aspects, the present disclosure provides methods and systems for using both types of tubing in a single string.

SUMMARY OF THE DISCLOSURE

In aspects, the present disclosure provides an apparatus for performing a wellbore operation, which may be a drilling operation or a non-drilling operation. The apparatus may include a string configured to be disposed in a wellbore. The string may include a rigid tubular, a connector coupled to the rigid tubular, a non-rigid tubular coupled to the connector; and at least one motor positioned along the string.

In aspects, the present disclosure provides a method for performing a wellbore operation. The method may involve disposing a string into a wellbore to perform one or more tasks. The string may include a rigid tubular, a connector coupled to the rigid tubular, a non-rigid tubular coupled to the connector; and at least one motor positioned along the string.

Examples of the more important features of the disclosure have been summarized in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For a detailed understanding of the present disclosure, reference should be made to the following detailed description of the embodiments, taken in conjunction with the accompanying drawings, in which like elements have been given like numerals, wherein.

DETAILED DESCRIPTION OF THE DISCLOSURE

As will be appreciated from the discussion below, aspects of the present disclosure provide a system for rotating a coiled tubing string to transmit energy for drilling or completion operations. The system may be configured by first disconnecting the coil tubing string from the dispensing reel and coupling an end of the coiled tubing string to a connector. The connector is also coupled to a string formed of jointed tubular. The jointed tubular may be rotated using a turning device or devices in the wellbore and/or at the surface. In certain embodiments, the coiled tubing and/or the jointed tubular string may be supported with stabilizers to reduce casing wear and buckling sensitivity. Moreover, in certain embodiments, one or more rotary power devices, such as drilling motors, may be distributed along the coiled tubing and/or the jointed tubular string. Illustrative embodiments are described below.

Figure 1:
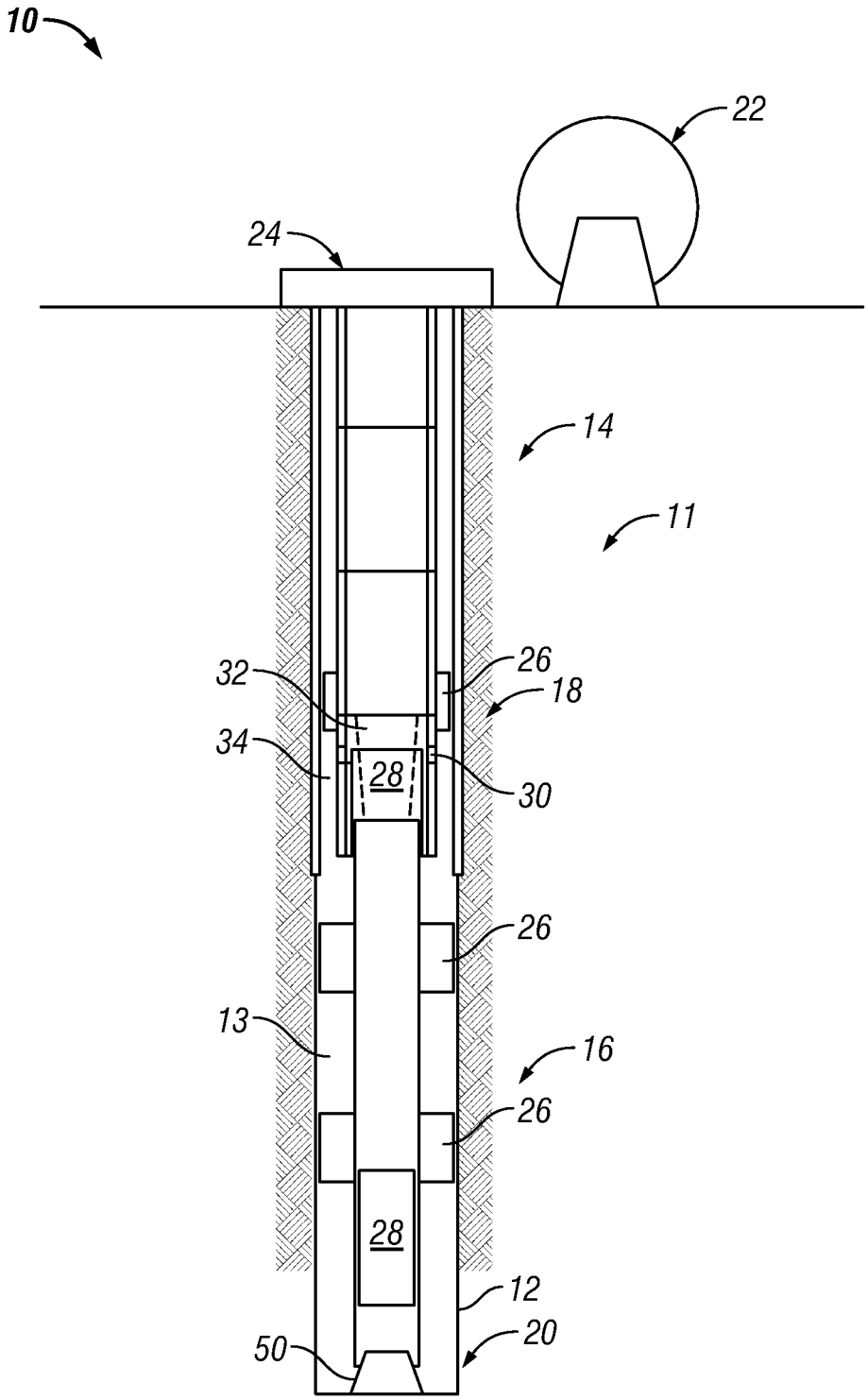
FIG. 1 schematically illustrates an exemplary wellbore construction system made in accordance with one embodiment of the present disclosure.

Referring initially to FIG. 1, there is shown a system 10 for performing a wellbore operation such as drilling the wellbore 12. In one embodiment, the system 10 includes a string 11 made up of a section of rigid tubular 14 (e.g., jointed tubular), a string of non-rigid tubular 16 (e.g., coiled tubing), a connector 18 that connects the rigid tubular string 14 to the non-rigid tubular string 16, and a bottomhole assembly (BHA) 20 coupled to an end of the non-rigid tubular string 16. As used herein, the term rigid and non-rigid are used merely in the relative sense to indicate that the strings 14 and 16 exhibit different responses to an applied loading. For instance, an applied torque that a jointed tubular can readily transmit may cause coiled tubing to fail. In one sense, a rigid tubular string may include segmented joints that include threaded ends whereas a non-rigid tubular may be a continuous tubular that may be coiled and uncoiled from a reel or drum (i.e., 'coilable').

At the surface, the well site may include known equipment for conveying coiled tubing and jointed tubular. For example, a hybrid rig may be used. Merely for illustration, there is shown a coiled tubing reel 22 and a portion of a top drive 24 for rotating the rigid tubular string 14.

As will be described in greater detail below, the system 10 may include devices such as stabilizers 26 for supporting the strings 14, 16, power devices 28 (e.g., transformers, mud motors, electric motors, turbines for rotating one or more portions of the strings 14, 16 and/or any other devices that use supplied energy to perform one or more assigned tasks), and bypass ports 30 for injecting high-pressure drilling fluid from the bore 32 to the annulus 34. As used herein, the term 'motor' refers to a device that converts energy into useful mechanical motion (e.g., rotation motion of the non-rigid string or bit, axial motion of BHA components, radial motion of stabilizer blades, etc.). As used herein, the term 'generator' refers to a device that coverts one form of energy into another form of energy. For example, an electric generator is a device that converts mechanical energy to electrical energy. A chemical energy generator is a device that converts electrical energy into chemical energy stored in reactive materials like oxygen and hydrogen. A thermal energy generator is a device that converts chemical energy in to heat energy by exothermic reaction of materials. As used herein, the term 'transformer' refers to a device that changes the relation of the physical parameters involved to describe the value; e.g., mechanical (straight movement) relation of [Force to Movement, F*s], Electrical [Current to Voltage] etc.

Figure 2:
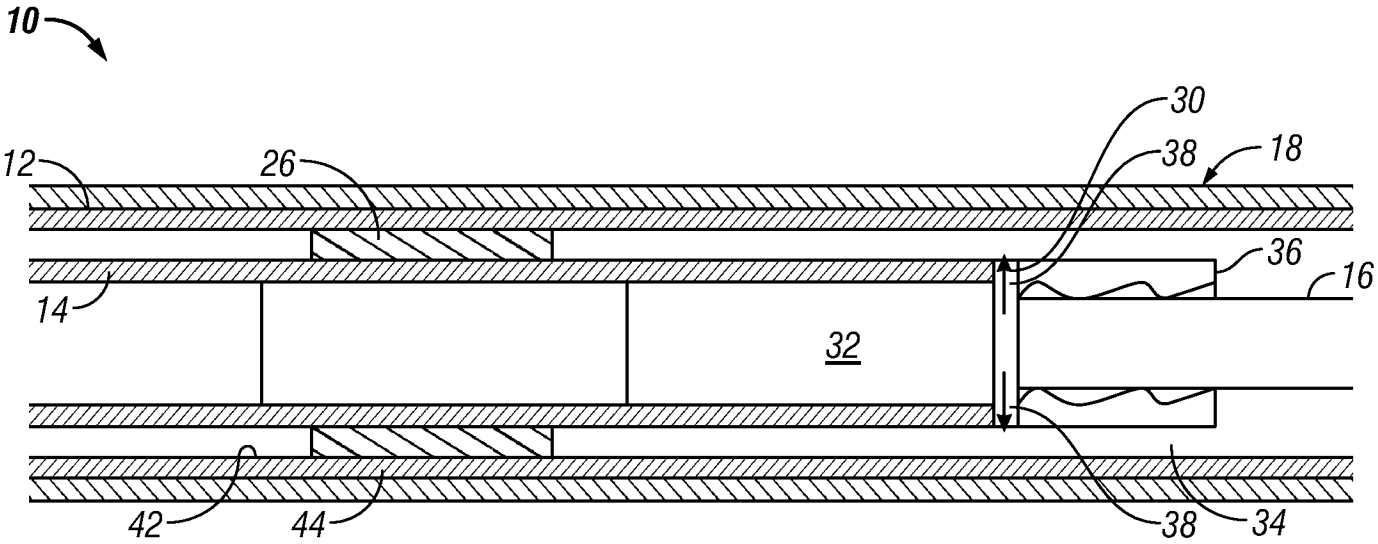
FIG. 2 schematically illustrates a portion of the drill string of the FIG. 1 system that includes a connector connecting a rigid string to a non-rigid string.
Figure 3:
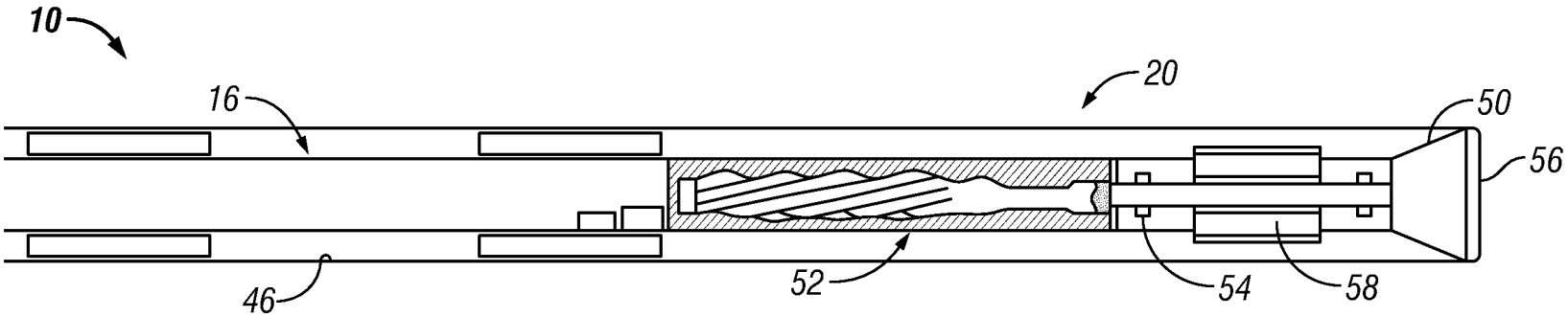
FIG. 3 schematically illustrates a section of the non-rigid drill string that includes a bottomhole assembly.

Referring now to FIG. 2, there is shown a portion of the system 10 that includes the connector 18 that connects the rigid string 14 to the non-rigid string 16. In some embodiments, the connector 18 is configured to only rotationally fix the rigid string 14 to the non-rigid string 16. Such a connection allows the transmission of rotary power from the rigid string 14 to the non-rigid string 16. In other embodiments, the connector 18 may include a rotary power device, such as a mud motor 36, for rotating the non-rigid string 16. In such embodiments, the non-rigid string 16 may be rotated by surface rotary power source (e.g., top drive 24 of FIG. 1) and / or the downhole motor 36. The motor 36 may be a motor energized by pressurized drilling fluid, clean hydraulic fluid, electrical power, engines using combustible fuels, or may use any other configuration suited for downhole applications. Additionally, as shown, the bypass ports 30 may be provided to convey a stream 38 of high pressure fluid in the bore 32 to the wellbore annulus 34. This fluid stream 38 may assist in returning drill cuttings entrained in the fluid flowing uphole via the annulus 34 to the surface. The bypass ports 30 may be positioned at the connector 18, at the motor 36, or in a separate sub or housing. Also, the rotor of the high-power motor may be connected in parallel to a power generators like electrical generators that are able to generate high voltage power for efficient power transmission to an remote electrical motor 52 (FIG. 3) and/or directly to rock destruction tools bits 50 (FIG. 3). Also, systems may for producing combustible material or fuel, e.g., oxygen or hydrogen, downhole may also be used. In some embodiments, electrical power transmission may use the rigid string 14 to convey electrical energy, e.g. a power circuit may be formed of the rigid string 14, the upper centralizer 26, and a casing string positioned in the wellbore.

One or more stabilizers 26 may be positioned on the strings 14, 16 to provide stability and strength to the strings 14, 16. Stability and strength may be desirable to minimize the effects of whirl, bit bounce, axial vibration, lateral vibration, buckling, etc. Numerous configurations may be used for the stabilizers 26. In some arrangements, the stabilizers 26 may be attached to and rotate with the strings 14, 16. In other arrangements, the stabilizers 26 may include bearings that allow the stabilizer to be relatively non-rotating. Non-rotating stabilizers may be useful when it is desired to limit the rubbing or other abrasive contact between the stabilizer 26 and a wall 42 of a wellbore tubular 44 or open hole 46 (FIG. 3). Also, the stabilizers may include fixed blades or dynamically adjustable blades. That is, these stabilizers may have a fixed blade height or an adjustable blade height. In one mode, the blade height may be adjusted to control drill string rotational speed; e.g., increasing the blade height changes the inertia moment of drill string elements to reduce speed whereas decreasing the blade height increases speed. Also, while some stabilizers center the drill string, other stabilizers may cause the desired eccentric positioning of the string in the wellbore. Still other stabilizers may act as anchors that clamp or connect to a wall 42 to absorb reaction forces (e.g., thrust, torsion, etc.) caused by devices such as the drill bit 50 (FIG. 3) and thruster 54 (FIG. 3). Non-blade or non-ribbed stabilizers may also be used; e.g., inflatable packer-like devices.

As noted above, the stabilizers 26 may be used to control axial vibration, lateral vibration, thrust, bit bounce, whirl, buckling, torsion, and other possible drilling dysfunctions. In some embodiments, the stabilizers 26 may be reconfigured (e.g., changing blade height or orientation) to control drilling dysfunctions. In other embodiments, the stabilizers 26 may cooperate with other devices, such as the power device 28, to control one or more drilling dysfunctions. For instance, a speed of a mud motor or local weight on bit provided by a thruster may be varied in coordination with the stabilizer 26.

Referring now to FIG. 3, there is shown a portion of the system 10 that includes the BHA 20. In one embodiment, the BHA 20 may include a drill bit 50 positioned at an end of the non-rigid string 16. The drill bit 50 may be rotated using the surface rotary power source (e.g., top drive 24 of FIG. 1) and/or the downhole motor 36 along the rigid string 14 (FIG. 2). In other embodiments, the drill bit 50 may be rotated using a rotary power device, such as a motor 52 or turbine, positioned along the non-rigid string 16.

In other embodiments, the BHA 20 may include devices that enhance drilling efficiency or allow for directional drilling. For instance, the BHA 20 may include a thruster 54 that applies a thrust to urge the drill bit 50 against a wellbore bottom 56. In this instance, the thrust functions as the weight-on-bit (WOB) that would often be created by the weight of the drill string. It should be appreciated that generating the WOB using the thruster 54 reduces the compressive forces applied to the non-rigid string 16. One or more stabilizers 26 (FIG. 2) that may be selectively clamped to the wall may be configured to have thrust-bearing capabilities to take up the reaction forces caused by the thruster 54. Moreover, the thruster 54 allows for drilling in non-vertical wellbore trajectories where there may be insufficient WOB to keep the drill bit 50 pressed against the wellbore bottom 56. Some embodiments of the BHA 20 may also include a steering device 58. Suitable steering arrangements may include, but are not limited to, bent subs, drilling motors with bent housings, selectively eccentric inflatable stabilizers, a pad-type steering devices that apply force to a wellbore wall, "point the bit" steering systems, etc. As discussed previously, stabilizers 26 may be used to stabilize and strengthen the strings 14, 16.

Figure 4:
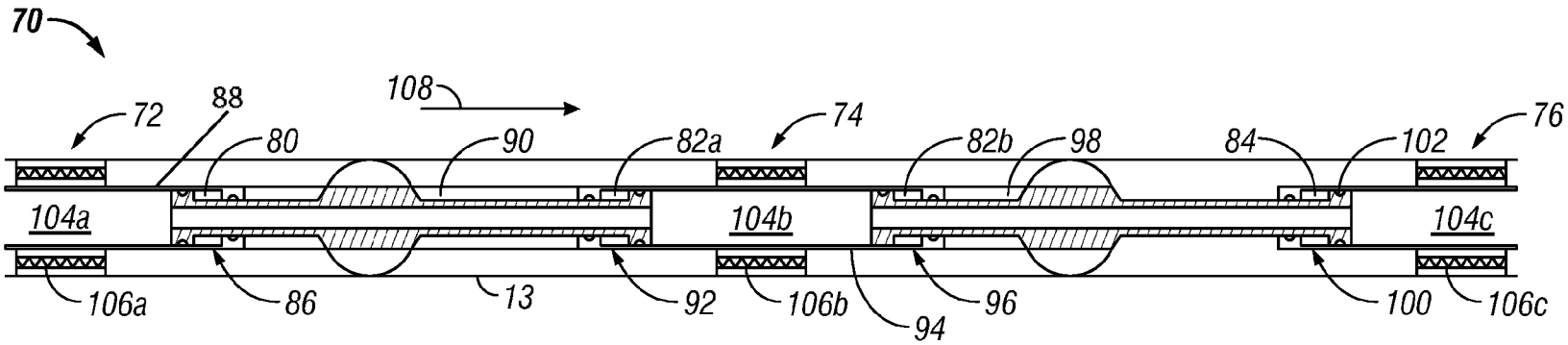
FIG. 4 schematically illustrates one embodiment of a tractor that may be used with a drill string in accordance with the present disclosure.

Referring now to FIGS. 1 and 4, there is shown one embodiment of a tractor 70 (FIG. 4) that may be used to convey the string 11 along the wellbore 12. The tractor 70 (FIG. 4) applies a tension force to the string 11 in order to pull the string 11 along the wellbore 12, which may include deviated or non-vertical sections. Referring primarily to FIG. 4, the tractor 70 may include motor sections 72, 74, and 76, each of which includes pressure chambers 80, 82*a,b*, and 84, respectively. Pressure chamber 80 is formed at a telescoping connection 86 between tubulars 88 and 90. Pressure chamber 82*a* is formed at a telescoping connection 92 between tubulars 90 and 94. Pressure chamber 82*b* is formed at a telescoping connection 96 between tubulars 94 and 98. Pressure chamber 84 is formed at a telescoping connection 100 between tubulars 98 and 102. Each motor section 72, 74, and 76 has a reset pressure chamber 104*a,b,c*, respectively. Each motor section 72, 74, and 76 also has expandable grippers

106*a,b,c*, respectively, that expand radially outward and anchor with a wellbore wall 13.

In an illustrative operating mode, gripper 106*c* is actuated to anchor the motor section 76 to the wellbore wall 13. Next, pressure may be applied to pressure chambers 84 and 82*b*, to move the tubular 98 in a downhole axial direction 108. The gripper 106*c* may be released from the wellbore wall 13 and gripper 106*b* may be activated to anchor to the wellbore wall 13. Next, pressure may be applied to pressure chambers 84 and 82*a*, to move the tubular 90 in a downhole axial direction 108 and to apply thrust. The gripper 106*b* may be released from the wellbore wall 13 and gripper 106*a* may be activated to anchor to the wellbore wall 13. At this stage, the tractor 70 is in a contracted or axially shortened position. Thereafter, pressure may be applied to the reset pressure chambers 104*a, b,c*. Applying pressure to the reset pressure chambers 104*a, b,c* translates or telescopically moves tubulars 90 and 98 out of their associated telescoping sections 86, 92, 96, and 100. At this stage, the tractor 70 is in an expanded or axially lengthened position and the operating mode repeats.

Figure 5A:
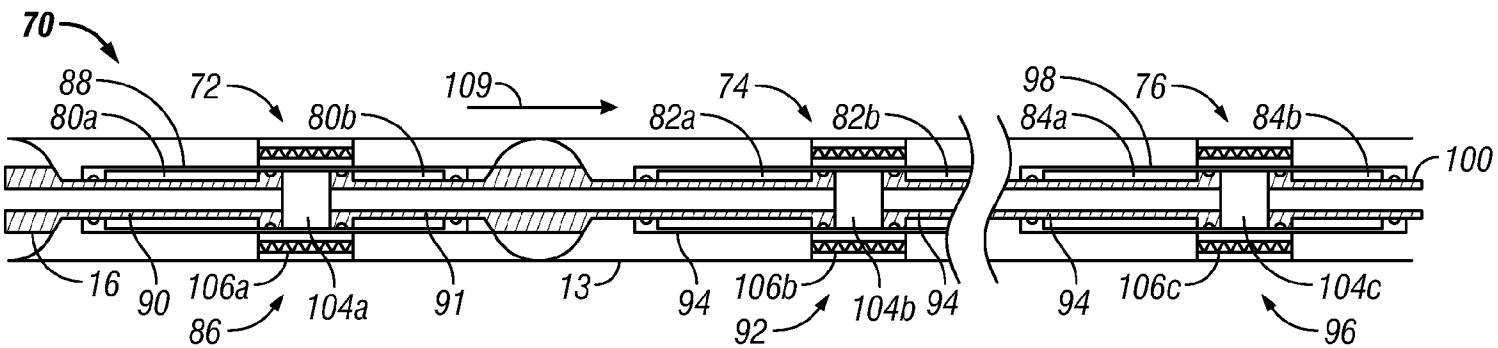
FIG. 5A schematically illustrates another embodiment of a tractor that may be used with a drill string in accordance with the present disclosure.

Referring now to FIG. 5A, there is shown a tractor 70 in a full contracted state. The tractors 70 of FIG. 4 and FIG. 5A are generally similar in that both embodiments include motor sections 72, 74, and 76. The FIG. 5A embodiment includes contraction chambers 80*a,b*, 82*a,b*, and 84*a,b*, respectively. The term "contraction" is used to indicate that energizing/pressurizing these chambers reduces the length of the tractor 70. Contraction chambers 80*a,b* are formed at a telescoping connection 86 between outer tubular 88 and inner tubulars 90, 91. Contraction chambers 82*a,b* are formed at a telescoping connection 92 between outer tubular 94 and inner tubulars 91, 94. Contraction chambers 84*a,b* are formed at a telescoping connection 96 between outer tubular 98 and inner tubulars 94, 100. Each motor section 72, 74, and 76 has a reset pressure chamber 104*a,b,c*, respectively. Each motor section 72, 74, and 76 also has expandable grippers 106*a,b,c*, respectively, that expand radially outward and anchor with a wellbore wall 13.

Figure 5B:
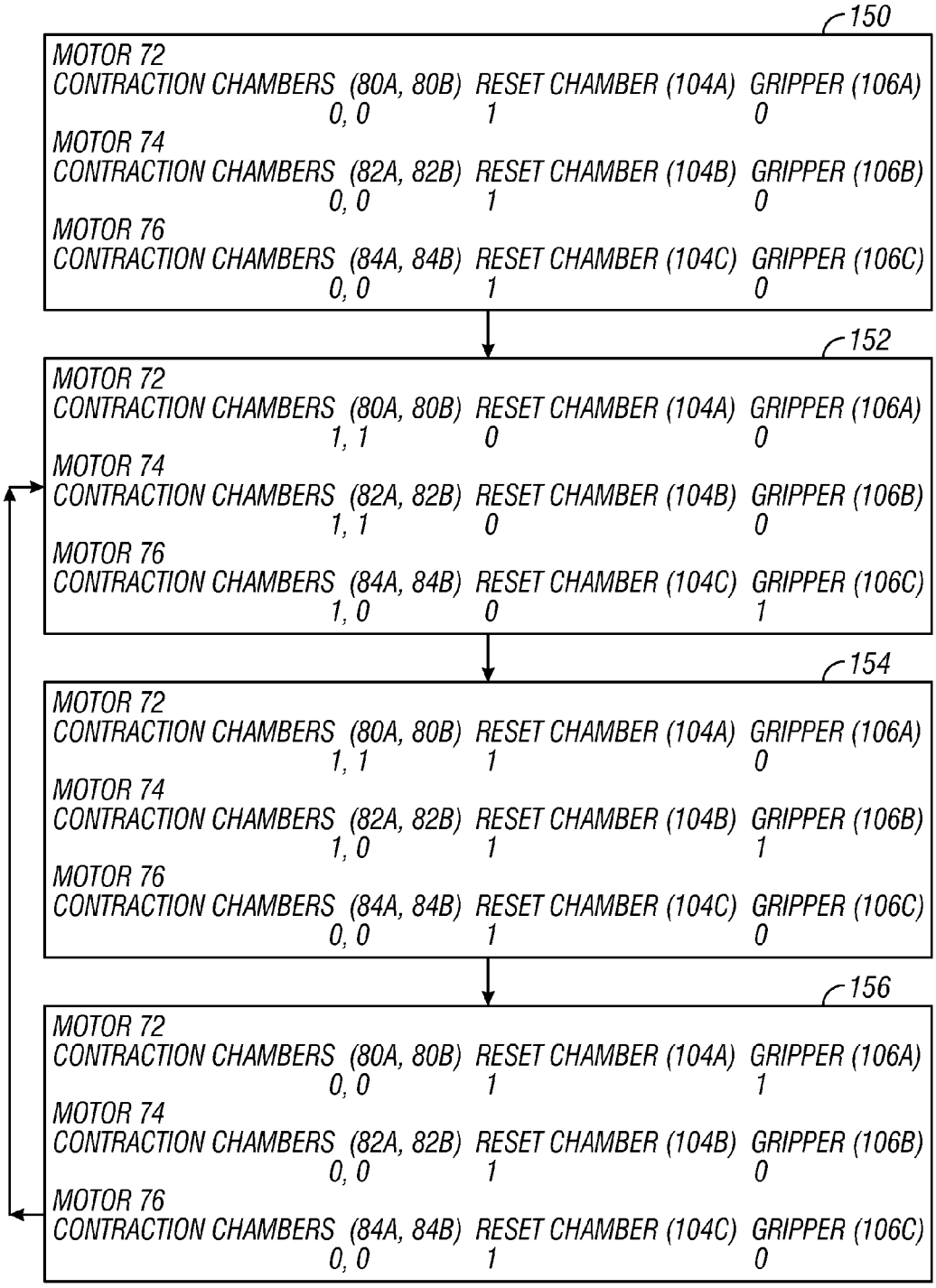
FIG. 5B depicts a flow chart showing one methodology of operating a tractor in accordance with the present disclosure.

Referring now to FIG. 5B, an illustrative operating method is shown for the the FIG. 5B tractor 70. For ease, the numeral "0" is used to indicate that pressure is not being applied to a chamber and the numeral "1" is used to indicate that pressure is being applied to a chamber.

Referring now to FIGS. 5A-B, step 150 shows the configuration of a "standard" drilling mode. In this drilling mode, the tractor 70 is in a fully expanded condition; i.e., all the reset chambers are maximized and activated, the contraction chambers are minimized, and all the grippers are de-activated (retracted).

During step 152, the gripper 106*c* and aft contraction chamber 84*a* of motor 76 and the contraction chambers 82*a* and 82*b* of motor 74, and the contraction chambers of 80*a* and 80*b* of motor 72 are energized at this step. These actions cause the motor 76 to anchor to the wellbore wall 13 and to "pull" the motors 72 and 74 and the upper section of the drill string in an axial downhole direction 109 with maximum speed. Motor 72 and Motor 74 are in a contracted stage at the end of the operation (FIG. 5B). And only the aft contraction chamber of Motor 76 is activated. The terms "forward" and "aft" are used merely to denote relative axial relationships.

At step 154, the gripper 106*b*, the aft contraction chamber 82*a*, and the reset chamber 104*b* of motor 74 are energized. Also, the reset chamber 104*c* of motor 76 and the reset chamber 104*a* of motor 72 are energized. All other chambers and grippers are de-energized. These actions cause the motor 74 to still pull the motor 72 and upper part of the drill string and push the motor 76.

At step 156, the gripper 106*a* and the reset chamber 104*a* of motor 74 are energized. Also, the reset chamber 104*b* of motor 74 and the reset chamber 104*c* of motor 76 are energized. All other chambers and grippers are de-energized. These actions cause the motor 72 to push the motor 74 and motor 76. At this point, the tractor 70 returns to a fully expanded condition. Thereafter, steps 150-154 are repeated as necessary.

It should be appreciated that the operation of the tractor 70 may be configured as necessary to move the drill string 70 and/or BHA components in the direction 109 or the opposing direction (i.e., either uphole or downhole). Also, it should be appreciated that two or more of the grippers 140*a-c* may be activated in parallel or simultaneously and the hydraulics of the motor sections 72-76 may be operated to distribute the thrust load to the grippers. For example, controls may be implemented to distribute loading or maximize gripping/stabilizing to enhance anchoring of the device in cased and/or open hole sections.

Figure 6A:
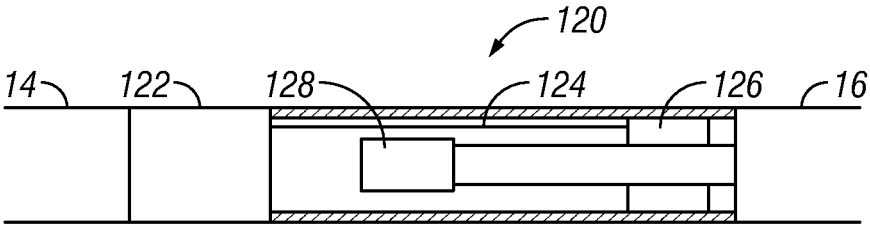
FIGS. 6A-6B schematically illustrate one embodiment of a connector in accordance with the present disclosure.
Figure 6B:
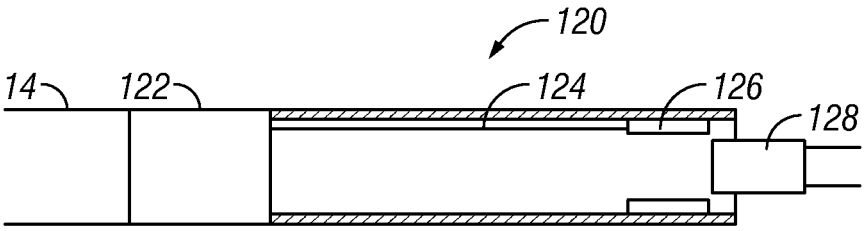

Referring now to FIGS. 6A and 6B, there is shown an embodiment of a connector 120 that may be used to selectively connect sections of the string 11 (FIG. 1). For example, the connector 120 may be the connector 18 of FIG. 1 that is used to connect the rigid string 14 to the non-rigid string 16. The connector 120 may include a downhole power unit 122, a control line 124, a clamping device 126, and a guide 128. The connection between the rigid string 14 and the non-rigid string 16 is formed by engagement of the clamping device 126, which is fixed to the rigid string 14, and the guide 128, which is fixed to the non-rigid string 16

As shown in FIG. 6A, the clamping device 126 may include clamping elements such as ribs or fingers that extend radially inward to engage the guide 128. As shown in FIG. 6A, the clamping elements retract radially outward to form a passage along which the guide 128 can slide out. The guide 128 may include a "catcher" or other suitable device that engages with the clamping device 126 or some other section of the rigid string 14 in the event that the rigid string 14 inadvertently separates from the non-rigid string 16.

The downhole power unit 122 provides the energy and control signals to actuate the clamping device 126. In embodiments where electrical power is used, the power unit 122 may provide electrical power and control signals, in which case the control line 124 may be configured to convey electrical signals. In embodiments where hydraulic power is used, the power unit 122 may provide pressurized hydraulic fluid, in which case the control line 124 may be configured to convey fluids. Thus, the clamping device 126 may be energized hydraulically, electrical, or by any other suitable means (e.g., surface manipulation). The downhole power unit 122 may include suitable communication devices that enable communication with the surface. Illustrative communication media include, but are not limited to, "wired pipe" (signal conductors that convey electrical signals or optical signals), mud pulses, acoustical signals, RF, etc. Thus, the connector 120 may be activated by surface signals to release the rigid string 14 from the non-rigid string 16 in the wellbore. Thus, the non-rigid string 16 may be left in the wellbore 12 while the rigid string 14 is retrieved to the surface or deployed in a different manner. The connector 120 may also be used to form a connection in the wellbore 12. For instance, the non-rigid string 16 may have been previously positioned in the wellbore 12. The string 11 may be conveyed into the wellbore 12 and connected to the non-rigid string 16 using the connector 120.

Referring now to FIG. 1, from the above, it should be appreciated that numerous methodologies are available for deploying the system 10. In one illustrative method of deployment, the non-rigid string 16 is conveyed into the wellbore 12. The string 16 may be used for drilling the wellbore 12 or for another activity. Non-drilling activities include casing installation, liner installation, casing/liner expansion, well perforation, fracturing, gravel packing, acid washing, tool installation or removal, etc. In such configurations, the drill bit 50 may not be present. When desired, the string 16 is detached from the reel 22 and connected to the rigid string 14 via the connector 18. The combined string 14, 16 is then conveyed into the wellbore.

In one mode of operation, the drill bit 50 may be rotated by a surface rotary power device such as the top drive 24. In this instance, the torque is transferred via the rigid string 14 and non-rigid string 16 to the drill bit 50. The stabilizers 26 may be distributed throughout the combined strings 14, 16 to reduce vibrations and enhance stability. In another mode of operation, the rotary power is generated in a step-wise and distributed fashion. For example, the rotary power applied to the drill bit 50 may be generated by three motors: a near bit motor 52, the motor 36 at the connector 18, and the surface top drive 24. In still another mode of operation, the drill bit 50 is rotated using rotary power generated downhole. That is, a surface rotary power generator is not used. Thus, depending on the dynamics of the strings 14, 16, the rotary power can be distributed as needed to optimize the delivery of rotary power to the drill bit 50. For instance, where coiled tubing is used in the non-rigid string 16, some or most of rotary power can be generated at the motor 52, which reduces the torsional loading on the non-rigid string 16. Further, the thruster device 54 may be used to generate WOB downhole of the non-rigid string 16, which may reduce the axial loading on the non-rigid string 16.

It should be understood that the drill bit 50 (FIG. 3) generally refers to any device that may be used to form the wellbore 12. For example, in certain embodiments, the device may use cutters that cut the rock or percussive cutting elements that disintegrate or remove rock by hammering (repetitive axial movement) on the wellbore bottom 56. In still other embodiments, the cutters may employ other forms of energy such as electrical energy or acoustical energy to vaporize the formation. The energy for such devices may be transmitted from the surface or may be generated downhole using downhole power generators that may be driven by downhole motors (e.g., motor 28 of FIG. 1). For instance, the motor 52 may generate electrical power instead of rotary power. In other embodiments, the motors 52 may supply high pressure fluid for fluid cutters.

The BHA 20 may include a variety of sensors and other devices positioned on the strings 14, 16. Illustrative sensors include, but are not limited to: sensors for measuring near-bit direction (e.g., BHA azimuth and inclination, BHA coordinates, etc.), temperature, vibration/dynamics, sensors and tools for making rotary directional surveys, an rpm sensor, a weight on bit sensor, sensors for measuring vibration, whirl, radial displacement, stick-slip, torque, shock, vibration, strain, stress, bending moment, bit bounce, axial thrust, friction and radial thrust. Illustrative devices include, but are not limited to, the following: one or memory modules and a battery pack module to store and provide back-up electric power; an information processing device that processes the data collected by the sensors; a bidirectional data communication and power module ("BCPM") that transmits control signals between the BHA 20 and the surface as well as supplies electrical power to the BHA 20; a mud-driven alternator: a mud pulser; and communication links using hard wires (e.g., electrical conductors, fiber optics), acoustic signals, EM or RF.

From the above, it should be appreciated that what has been described includes, in part, an apparatus for performing a wellbore operation that may include a string configured to be disposed in a wellbore. The string may include a rigid tubular, a connector coupled to the rigid tubular, a non-rigid tubular coupled to the connector; and at least one motor positioned along the string.

From the above, it should be appreciated that what has been described includes, in part, a method for performing a wellbore operation. The method may involve disposing a string into a wellbore to perform one or more tasks. The string may include a rigid tubular, a connector coupled to the rigid tubular, a non-rigid tubular coupled to the connector; and at least one motor positioned along the string.

While the foregoing disclosure is directed to the one mode embodiments of the disclosure, various modifications will be apparent to those skilled in the art. It is intended that all variations within the scope of the appended claims be embraced by the foregoing disclosure.

What is claimed is:

1. An apparatus for performing a wellbore operation, comprising:

a reel;

a string configured to be disposed in a wellbore, the string including:

a first section that includes a rigid tubular;

a connector coupled to the rigid tubular;

a second section that includes a coilable non-rigid tubular coupled to the connector, the coilable non-rigid tubular being storable on the reel;

at least one stabilizer positioned along the second section; and at least one motor positioned along the string; and a surface rotary power device rotating the first section, and wherein the at least one motor is positioned at the connector and configured to apply rotary power to the non-rigid tubular.

2. The apparatus of claim 1, wherein the at least one motor includes a plurality of motors positioned along the string, wherein the plurality of motors are each configured to generate rotary power for rotating a drill bit connected to the string.

3. The apparatus of claim 1, wherein the at least one motor includes a first motor interposed between the rigid tubular and the non-rigid tubular and a second motor interposed between the non-rigid tubular and a drill bit connected to an end of the string, wherein the first motor applies rotary power to the non-rigid tubular and the second motor applies rotary power to the drill bit.

4. The apparatus of claim 1, further comprising at least one generator configured to produce an energy selected from one of: (i) electrical power, and (ii) fuel;

and a drill bit connected to the string, the drill bit configured to use the selected energy to form the wellbore.

5. The apparatus of claim 1 wherein the rigid tubular is a plurality of jointed tubulars, the non-rigid tubular is a continuous coiled tubing string, and further comprising a bottom hole assembly connected to an end of the non-rigid tubular, the bottomhole assembly being rotated by at least one of the rigid tubular and the non-rigid tubular.

6. The apparatus of claim 1, further comprising a tractor connected to the string, the tractor being configured to one of: (i) pull the string, (ii) push the string, and (iii) anchor the string along the wellbore, wherein the tractor has at least three grippers configured to selectively anchor against a wellbore wall.

7. The apparatus of claim 1, wherein the connector includes:

a clamping device;

a guide selectively connecting with the clamping device; and a downhole power device actuating the clamping device in response to a control signal; and wherein the connector is configured to one of: (i) connect the rigid tubular with the non-rigid tubular when the downhole power device receives the control signal in the wellbore, and (ii) disconnect the rigid tubular with the non-rigid tubular when the downhole power device receives the control signal in the wellbore.

8. An apparatus for performing a wellbore operation, comprising:

a reel;

a string configured to be disposed in a wellbore, the string including:

a first section that includes a rigid tubular;

a connector coupled to the rigid tubular;

a second section that includes a coilable non-rigid tubular coupled to the connector, the coilable non-rigid tubular being storable on the reel;

at least one stabilizer positioned along the second section; and at least one motor positioned along the string; and a drill bit connected to an end of the string, a thruster applying a thrust to the drill bit, wherein the at least one stabilizer locks the second section to the wellbore while the thruster applies the thrust to the drill bit.

9. A method for performing a wellbore operation, comprising:

forming a string by connecting a rigid tubular to a coilable non-rigid tubular with a connector;

positioning at least one motor on the string, wherein the at least one motor is positioned at the connector to apply rotary power to the non-rigid tubular;

disposing the string in a well by using a reel on which the coilable non-rigid tubular is stored;

positioning at least one stabilizer along the coilable non-rigid tubular;

rotating the rigid tubular using a surface rotary power device, and rotating the non-rigid tubular using the at least one motor.

10. The method of claim 9 further comprising positioning the at least one motor at the connector and rotating the non-rigid tubular with the at least one motor.

11. The method of claim 9, wherein the at least one motor includes a first motor and a second motor, and further comprising interposing the first motor between the rigid tubular and the non-rigid tubular, interposing the second motor between the non-rigid tubular and a drill bit connected to an end of the string, rotating the non-rigid tubular with the first motor, and rotating the drill bit with the second motor.

12. The method of claim 9, wherein the rigid tubular is a plurality of jointed tubulars, and the non-rigid tubular is continuous coiled tubing string, and further comprising connecting a bottom hole assembly to an end of the non-rigid tubular, and rotating the bottomhole assembly using at least one of the rigid tubular and the non-rigid tubular.

13. The method of claim 9, further comprising stabilizing the string using at least one stabilizing device positioned along the string, the at least one stabilizing device being configured to selectively lock the string to the wellbore.

14. The method of claim 13, wherein the at least one stabilizing device is configured to control one of: (i) axial vibration, (ii) lateral vibration, (iii) thrust, (iv) bit bounce, (v) whirl, (vi) buckling, and (iv) torsion.

15. The method of claim 14, further comprising using the at least one motor with at least one stabilizing device to control one of: (i) axial vibration, (ii) lateral vibration, (iii) thrust, (iv) bit bounce, (v) whirl, (vi) buckling, and (iv) torsion.

16. The method of claim 9, further comprising: sending a signal from the surface into the wellbore; activating the connector to release the rigid string from the non-rigid string after receiving the signal at the connector, and retrieving the rigid string while leaving the non-rigid string in the wellbore.

17. A method for performing a wellbore operation, comprising:

forming a string by connecting a rigid tubular to a non-rigid tubular with a connector, wherein the connector includes:

a clamping device;

a guide selectively connecting with the clamping device; and a downhole power device actuating the clamping device in response to a control signal; and wherein the connector is configured to one of: (i) connect the rigid tubular with the non-rigid tubular when the downhole power device receives the control signal in the wellbore, and (ii) disconnect the rigid tubular with the non-rigid tubular when the downhole power device receives the control signal in the wellbore;

positioning at least one power generator on the string;

disposing the string in a well;

sending the control signal from the surface into the wellbore;

releasing the rigid tubular from the non-rigid tubular while the connector is in the wellbore and after receiving the control signal at the connector; and retrieving the rigid tubular from the wellbore while leaving the non-rigid tubular in the wellbore.

18. The method of claim 17, wherein the power generator is one of:

(i) a motor, (ii) a generator, and (iii) an energy source.

* * * * *